US007697864B2

(12) United States Patent
Inaba et al.

(10) Patent No.: US 7,697,864 B2
(45) Date of Patent: Apr. 13, 2010

(54) DEVELOPING DEVICE

(75) Inventors: Shigeru Inaba, Kanagawa (JP); Shota Oba, Kanagawa (JP); Takashi Yamamuro, Kanagawa (JP); Makoto Hirota, Kanagawa (JP); Masahiro Andoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 189 days.

(21) Appl. No.: 11/902,295

(22) Filed: Sep. 20, 2007

(65) Prior Publication Data

US 2008/0199210 A1 Aug. 21, 2008

(30) Foreign Application Priority Data

Feb. 21, 2007 (JP) ..... 2007-041120

(51) Int. Cl.
*G03G 15/08* (2006.01)

(52) U.S. Cl. ..... 399/103; 399/105

(58) Field of Classification Search ..... 399/91, 399/98, 102, 103, 105, 111, 119, 120, 252, 399/265, 276, 279, 286
See application file for complete search history.

(56) References Cited

U.S. PATENT DOCUMENTS 5,202,729 A * 4/1993 Miyamoto et al. ..... 399/103
5,701,558 A * 12/1997 Kojima ..... 399/103
6,654,576 B2 * 11/2003 Dougherty ..... 399/103

FOREIGN PATENT DOCUMENTS

JP A-01-234871 9/1989
JP A-2005-338599 12/2005

* cited by examiner

*Primary Examiner*—Hoan H Tran
(74) *Attorney, Agent, or Firm*—Morgan, Lewis & Bockius LLP

(57) ABSTRACT

A developing device includes a housing that stores developer; a developing roll that is rotatably supported in the housing and has a developing region with a roughened surface that supplies developer to an image region of an image holding member; a step portion that is formed at both sides of the developing region of the developing roll and whose diameter is smaller than that of the developing region; and a seal member that contacts a region of the step portion that is opposite to the image holding member.

7 Claims, 6 Drawing Sheets

DEVELOPING DEVICE

CROSS-REFERENCE TO RELATED APPLICATION

This application is based on and claims priority under 35 USC 119 from Japanese Patent Application No. 2007-41120 filed Feb. 21, 2007.

BACKGROUND

1. Technical Field

The present invention relates to a developing device applied to image-forming devices such as copiers, printers, and facsimiles (or machines that are combinations of these) that form images using an electrophotographic system. The device develops an electrostatic latent image formed on an image holding member with developer.

2. Related Art

There are developing devices that form a layer of developer on a developing roll, where the developer is supplied onto a photoreceptor drum from this layer of developer, whereby an electrostatic latent image formed on the photoreceptor drum becomes visible. With this kind of developing device, it is necessary to control the device so that portions outside the image region regulated on the photoreceptor drum are not developed. For this reason, a developing region in which the layer of developer is formed correspond to the image region is provided on the developing roll.

The following is one example of a method for regulating the developing region of the developing roll. First, a processing region (i.e., developing region) for raising the conveying properties of the developer is formed on the developing roll. The developer is then applied to only the processing region utilizing the difference in conveying properties of the developer between the portion where the processing region has been formed and the other portions.

The surface roughness of the developing region on the developing roll is increased, for example, by performing blast processing thereon. Blast processing is not performed on portions outside the developing region, and those portions are left as they are, i.e., as smooth unprocessed surfaces. Due to this, developer is applied to the portions on the developing roll where blast processing is performed. At this time, developer is not applied to the unprocessed portions. In this manner, the developing region on the developing roll can be regulated.

With this method, at the time of contact between the developing roll and the photoreceptor drum, the pressure applied to the surface of the developing roll is exerted towards roll end portions of the developing roll. For this reason, the developer applied on the portions that received blast processing tends to flow to the smooth unprocessed portions. Due to this, the width of the layer of developer may not be sufficiently regulated.

There is also a method where the developing region is regulated by covering the both end portions of the developing roll that are not blast processed with a seal member. This method is sufficient as a method for regulating the developing region, but, the flow of developer that contacts the edge portion of the seal member is obstructed. For this reason, that developer stagnates or accumulates, whereby the layer thickness of the developer layer in the vicinities of the edge portions of the seal member increases. Due to this, developing fog may occur on the developing roll.

Here, as shown in FIG. 6A, a method can be considered where the developing region on a developing roll 100 is blast processed to raised the surface roughness, and then both end portions of the developing roll 100 are covered with a seal member 102. However, even with this type of configuration, developer enters in between the seal member 102 and the developing roll 100. When the seal member 102 is lifted up due to the developer that has entered in between the seal member 102 and the developing roll 100, the seal member 102 contacts a photoreceptor drum 104. Due to this, there is a concern that localized abrasion may occur on the photoreceptor drum 104.

Also, as shown in FIG. 6B, there is a method where the seal member 102 is set in a state of no-contact with the surface of the developing roll 100. This method prevents the lifting up of the seal member 102 due to developer that has entered between the seal member 102 and the developing roll 100. However, in this case, the distance between the seal member 102 and the photoreceptor drum 104 decreases, whereby there is a problem in that it becomes easier for the seal member 102 to contact the photoreceptor drum 104. Further, there are cases where magnetic force reaches portions of the developing roll 100 covered by the seal member 102. At this time, it becomes easier for the developer to enter in between the seal member 102 and the developing roll 100, and there is a concern that the seal member 102 may be lifted upward.

Further, as shown in FIG. 6C, a method can also be considered where the width of the portion on which blast processing is performed is made larger than the image region. Here, a seal member 102 is provided in a state of no-contact at both end portions of the region on which blast processing is performed. However, in this case as well, the distance between the seal member 102 and the photoreceptor drum 104 decreases. For this reason, there is a concern that the seal member 102 may contact the photoreceptor drum 104 and abrade the photoreceptor drum 104.

SUMMARY

According to an aspect of the present invention, there is provided a developing device comprising: a housing that stores developer; a developing roll that is rotatably supported in the housing and has a developing region with a roughened surface that supplies developer to an image region of an image holding member; a step portion that is formed at both sides of the developing region of the developing roll and whose diameter is smaller than that of the developing region; and a seal member that contacts a region of the step portion that is opposite to the image holding member.

DESCRIPTION OF THE INVENTION

Figure 1:
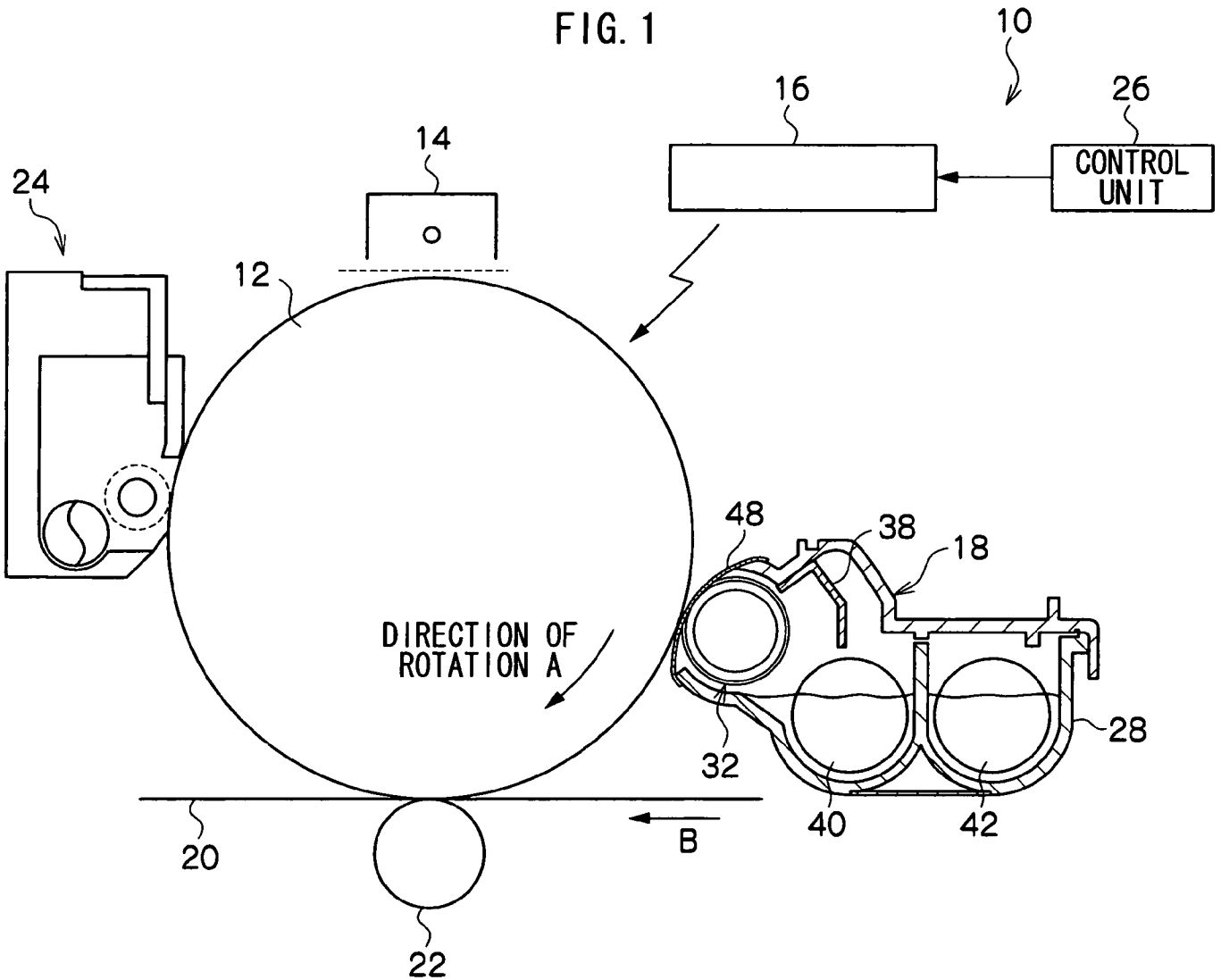
FIG. 1 is a schematic drawing of an image-forming device equipped with a developing device according to an exemplary embodiment of the present invention.

FIG. 1 shows a schematic configurational view of an image-forming device 10 equipped with a developing device 18 according to an exemplary embodiment of the present invention.

(General Outline of Image-Forming Device)

The image-forming device 10 is provided with a photoreceptor drum 12 on which an electrostatic latent image is formed in accordance with image information with a well-known electrophotographic process.

A charging device 14, an exposing device 16, the developing device 18, a transfer roll 22, and a cleaning member 24 are arranged along the direction of rotation of the photoreceptor drum 12 (in the direction of the A arrow) in the periphery of this photoreceptor drum 12. The charging device 14 is for uniformly charging the photoreceptor drum 12. The exposing device 16 emits light beams in accordance with image information onto the photoreceptor drum 12 charged by the charging device 14. An electrostatic latent image is formed on the photoreceptor drum 12 by the exposing device 16. The developing device 18 develops the electrostatic latent image formed on the photoreceptor drum 12. The transfer roll 22 is used for transferring the toner image developed with the developing device 18 onto an image-receiving member 20 such as a recording medium conveyed in a preset direction (in the direction of the B arrow). The cleaning member 24 removes residual toner on the photoreceptor drum 12 when transferred to the image-receiving member 20.

The image-forming device 10 also includes a control unit 26 for controlling each part of the device provided in the image-forming device 10.

With this type of configuration, firstly, the photoreceptor drum 12 is rotated in a preset direction (the direction of the A arrow in FIG. 1) in accordance with control signals from the control unit 26, then the surface of the photoreceptor drum 12 is uniformly charged by the charging device 14. Next, light beams are irradiated onto the photoreceptor drum 12 by the exposing device 16 in accordance with image information. In this way, an electrostatic latent image is formed on the photoreceptor drum 12. When the region where the electrostatic latent image is formed on this photoreceptor drum 12 reaches the developing region of the developing device 18 (i.e., the region where the electrostatic latent image on the photoreceptor drum 12 is developed by the developing device 18), the electrostatic latent image on the photoreceptor drum 12 is developed by the developing device 18. The toner image formed on the photoreceptor drum 12 due to development is transferred to the image-receiving member 20 by the transfer roll 22.

The toner image transferred to the image-receiving member 20 is fixed on the image-receiving member 20 with a fixing device not shown in the drawings.

The residual toner on the photoreceptor drum 12 is then removed by the cleaning member 24.

Note that with the present exemplary embodiment, an example is shown where a toner image is transferred onto the image-receiving member 20 such as a recording medium, however, an intermediate transfer member is used as the image-receiving member 20 and a toner image transferred to the intermediate transfer may be transferred to the recording medium.

(Developing Device)

Next, the developing device 18 according to an exemplary embodiment of the present invention will be explained.

Figure 2:
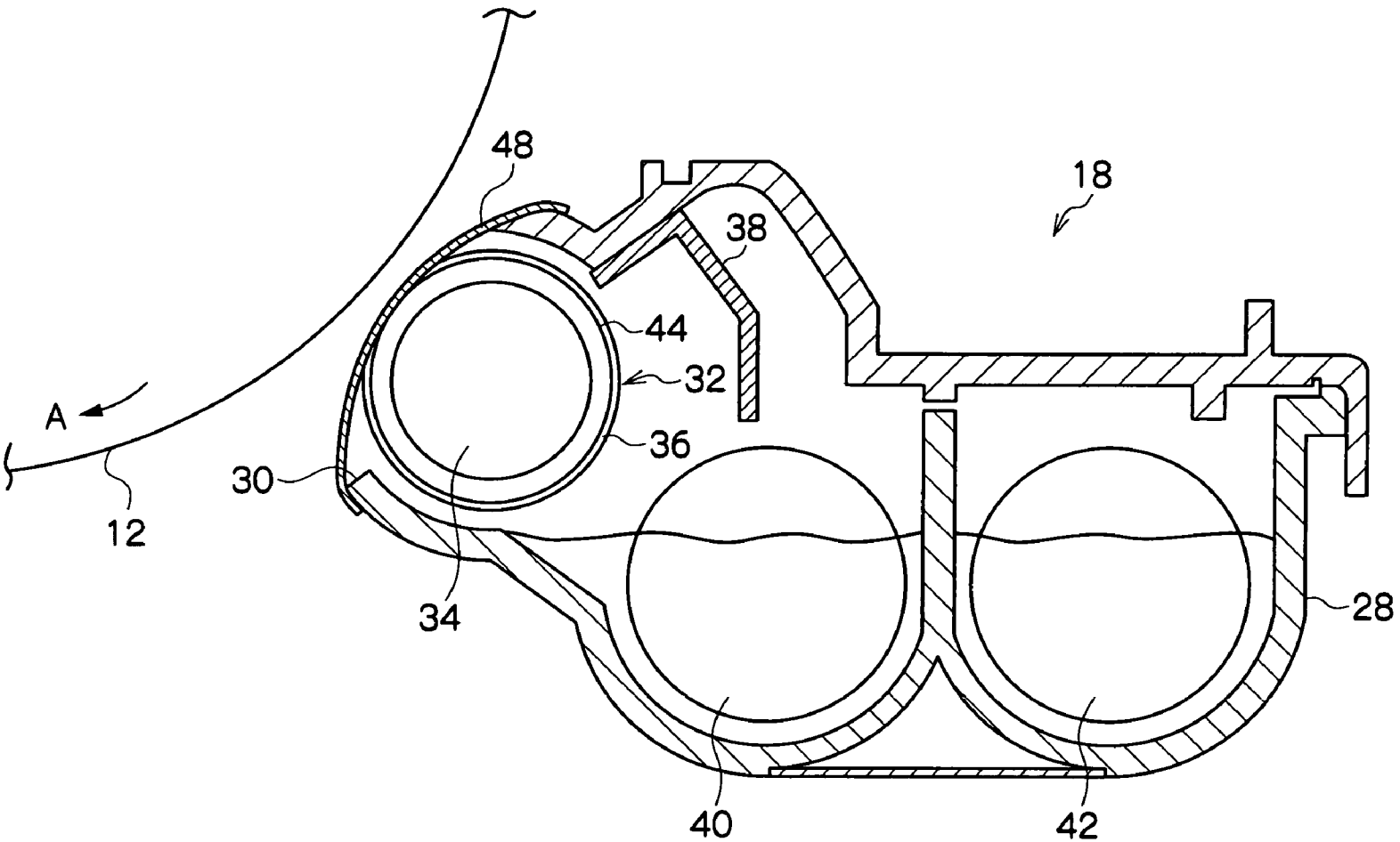
FIG. 2 is a cross-sectional drawing of developing device according to an exemplary embodiment of the present invention.

As shown in FIG. 2, the developing device 18 is provided with a housing 28 in which a two component developer made from non-magnetic toner and a magnetic carrier is stored. An opening 30 is formed at a position of the housing 28 facing the photoreceptor drum 12. A portion of a developing roll 32 that bears developer is exposed from the opening 30.

The developing roll 32 has a magnet roll 34 in which multiple magnetic poles are alternately magnetized in the peripheral direction. Further, the developing roll 32 has a non-magnetic developing sleeve 36 that rotates around the periphery of the magnet roll 34.

Rotational force is transmitted to from a drive motor that is not shown. The developing sleeve 36 is rotationally driven in the opposite direction (the direction of the B arrow in FIG. 1) to the direction of rotation of the photoreceptor drum 12 (the direction of the A arrow).

A layer thickness-regulating member 38 is arranged in the housing 28 along the axial direction of the developing roll 32 in the vicinity of the developing roll 32. The layer thickness of the developer supplied onto the developing roll 32 is regulated by the layer thickness-regulating member 38. The developer on the developing roll 32 passes through the layer thickness-regulating member 38, whereby a magnetic brush of a preset height is formed on the developing roll 32 (on the developing sleeve 36). The magnetic brush then rubs against the photoreceptor drum 12 with the rotation of the magnet roll 34.

A pair of agitating/conveying augers 40, 42 that agitate and convey the developer is arranged at the back surface side of the developing roll 32. The agitating/conveying augers 40, 42 comprise screw members that serve as agitating members that rotate in directions that are opposite each other. The agitating/conveying augers 40, 42 convey toner replenished from a toner cartridge (not shown). The agitating/conveying augers 40, 42 also convey and circulate the developer in directions opposite from each other and sufficiently agitate and mix the toner and carrier. Due to this, the toner and the carrier are frictionally electrified, uniformly mixed, and supplied to the developing roll 32 as a two component developer.

The carrier that is mixed in the developer has magnetism so that the developer is made to attract due to the magnetic field generated from the magnet roll 34. The developer adheres on the peripheral surface of the developing sleeve 36 in layer form, thereby forming a developer layer P.

The developer layer P is regulated to a predetermined layer thickness by the layer thickness-regulating member 38 and is conveyed to a developing region M. At this time, the carrier in the developer is attracted to the surface of the developing sleeve 36. The magnetic brush around which toner is adhered is then formed between the developing sleeve 36 and the photoreceptor drum 12. At this time, only non-magnetic toner moves to the photoreceptor drum 12 side. In this way, an electrostatic latent image formed on the surface of the photoreceptor drum 12 is developed by the toner. Meanwhile, the developer after its toner has been used (comprising mainly the carrier) is conveyed as is adhered to the surface of the developing sleeve 36 and recovered inside the housing 28.

Figure 3:
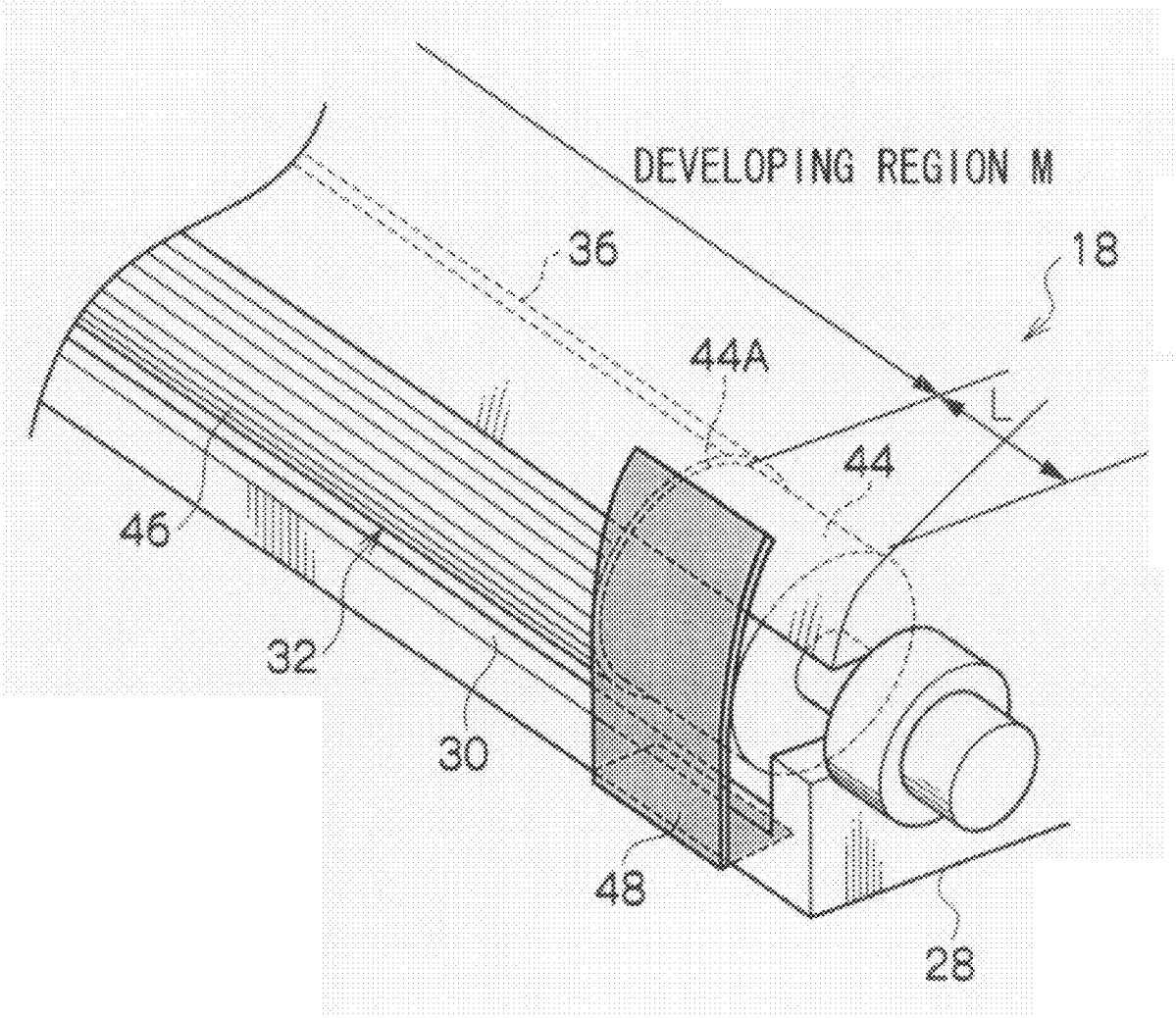
FIG. 3 is a partial perspective view of a developing device according to an exemplary embodiment of the present invention.

Here, as shown in FIG. 3, both end portions of the developing sleeve 36 in the longitudinal direction are made to have smaller diameters and step portions 44 are formed at these end portions. The region between wall surfaces 44A of the step portions 44 is the developing region M where the developer layer P is formed. In other words, the size in the widthwise direction of the developing region M is regulated by the step portion 44.

With the present exemplary embodiment, the entire length of the developing roll 32 (developing sleeve 36) is 322 mm. Also, the step portions 44 formed at both ends of the developing roll 32 have a width L of 10 mm and a depth (i.e., height of the wall surface 44A) of 0.1 mm. Accordingly, the width of the developing region M is regulated to 302 mm (i.e., a value where the tolerance has been assumed relative to a printable region of 300 mm).

Multiple V-shaped grooves (V grooves) 46 are formed at preset intervals in the rotational direction along the axial direction at depths of 0.09 mm in the developing region M of the developing roll 32. In other words, the developing region M is subjected to a surface roughening process.

In this way, the ability to convey developer is improved in the developing region M on which the surface roughening process is performed and the developer layer P is formed on the developing region M.

Seal members 48 with widths of 10 mm and thicknesses of 0.1 mm are bridged over the opening 30 of the housing at both end portions in the longitudinal direction of the opening 30 of the housing 28. This seal member 48 is in contact with the step portion 44 of the developing sleeve 36 that is exposed from the opening 30.

Figure 4:
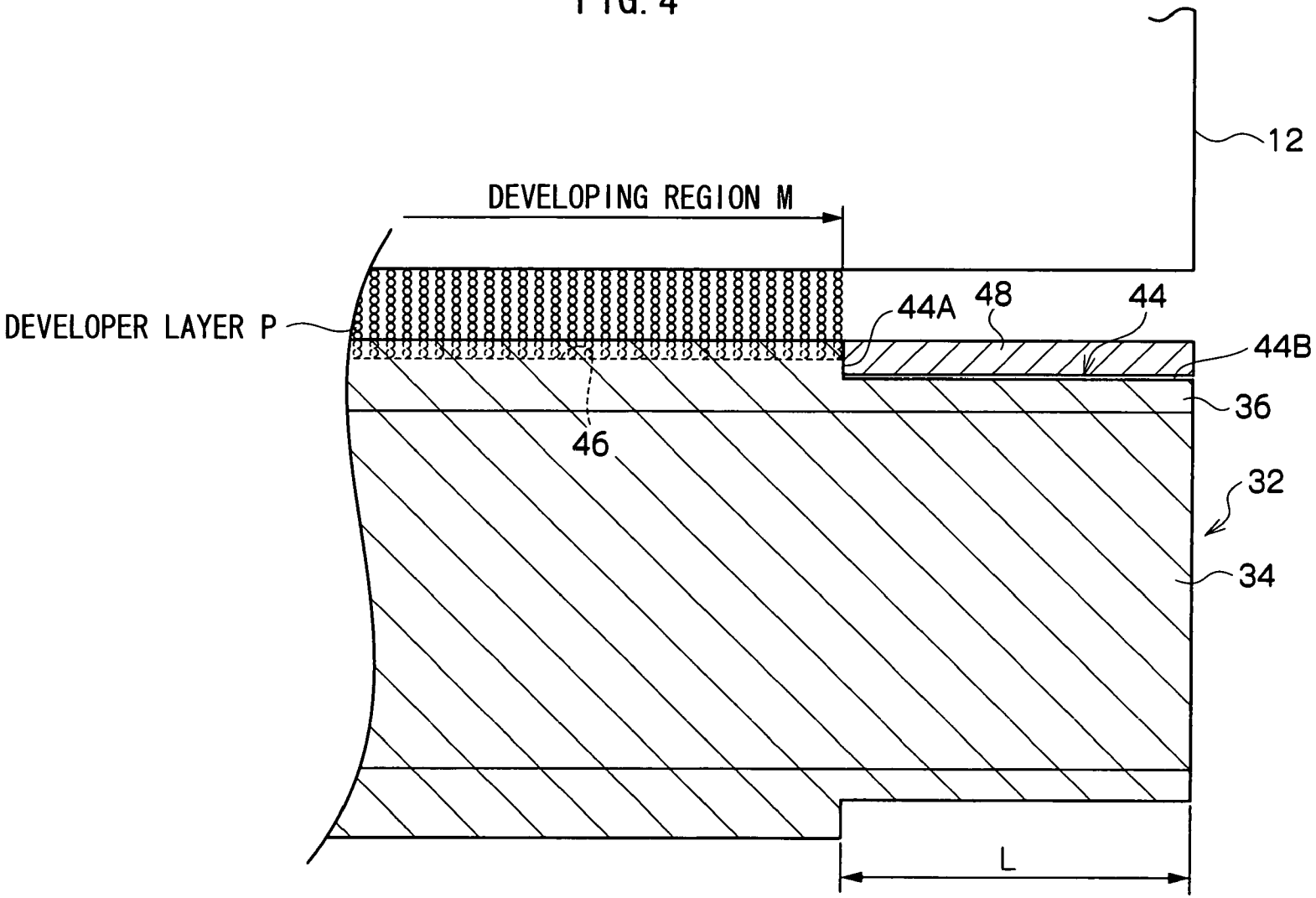
FIG. 4 is a cross-sectional drawing showing state where a seal member is attached to a developing roll according to an exemplary embodiment of the present invention.

The seal members 48 are made from a rubber material (i.e., elastic material) such as silicone or polyurethane and, as shown in FIG. 4, the edge portion of the seal member 48 in the widthwise direction is brought into contact with the wall surface 44A of the step portion 44.

When the seal member 48 is bridged over the opening 30 of the housing 28, first, the bottom edge portion in the longitudinal direction of the seal member 48 is attached to the bottom portion of the housing 28. Then, while pulling the seal member 48, the upper edge portion is attached to the upper wall of the housing 28. In this manner, the seal member 48 is bridged over the opening 30 of the housing 28 in a state where tensile force is exerted thereupon to be brought into contact with the step portion 44. For this reason, the contact pressure between the seal member 48 and a bottom surface 44B of the step portion 44 becomes higher.

Figure 5A:
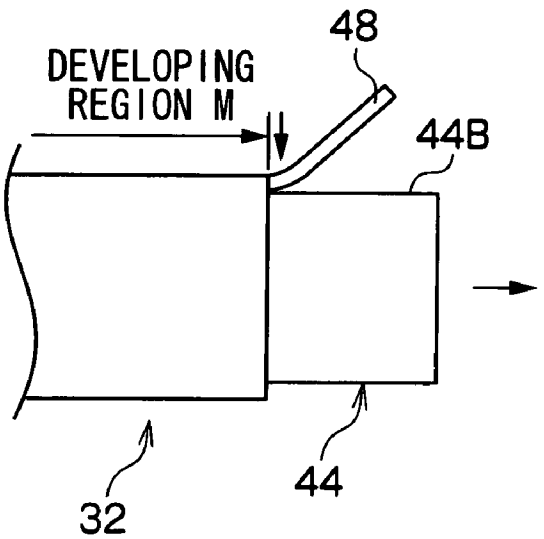
FIG. 5A-FIG. 5C are side views showing the process for attaching a seal member to a developing roll according to an exemplary embodiment of the present invention.
Figure 5B:
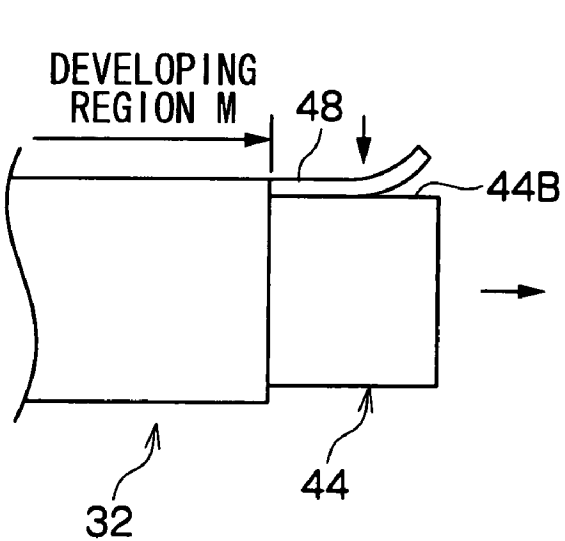
Figure 5C:
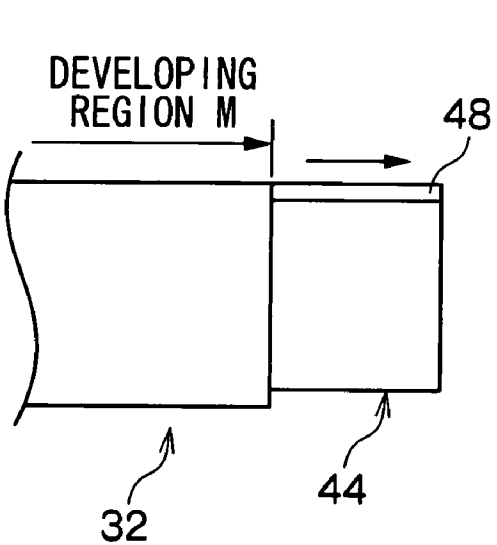
Figure 6A:
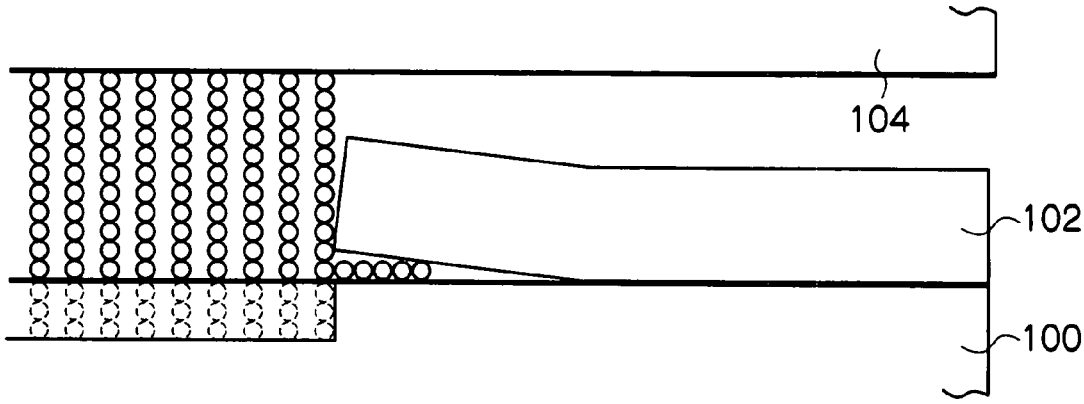
FIG. 6A is a cross-sectional drawing showing a state where a seal member is attached to a conventional developing roll.
Figure 6B:
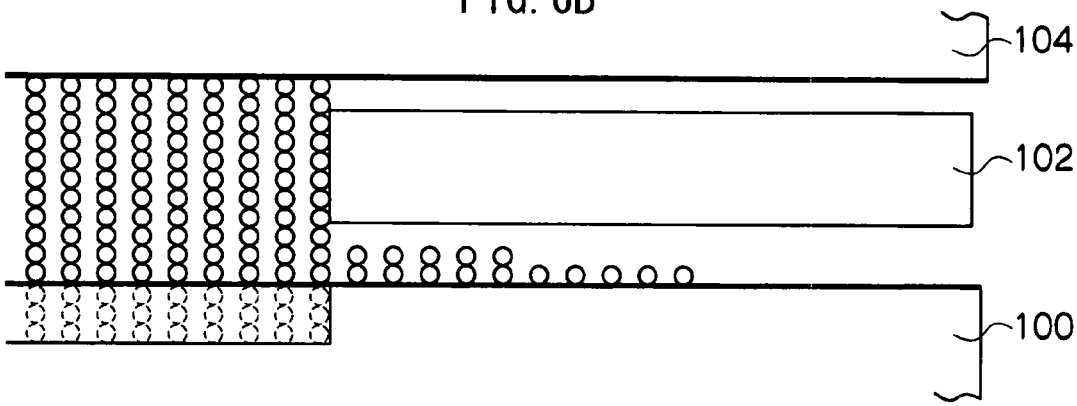
FIG. 6B is a cross-sectional drawing showing a state where a seal member is attached to a conventional developing roll.
Figure 6C:
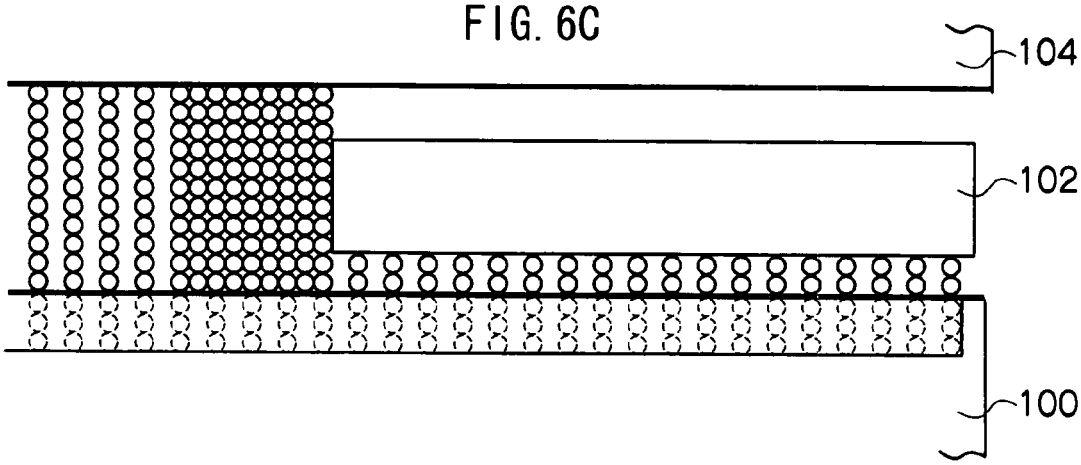
FIG. 6C is a cross-sectional drawing showing a state where a seal member is attached to a conventional developing roll.

At this time, as shown in FIG. 5, the developing region M side in the widthwise direction of the seal member 48 is first attached to the housing 28 (see FIG. 3). Then the remaining portions of the seal member 48 are attached toward the end portion side of the developing roll 32 (FIGS. 5B and 5C). In this manner, the contact pressure of the seal member 48 on the bottom surface 44B of the step portion 44 (at the developing region M side) becomes higher than the end portion side of the developing roll 32.

Next, the effect of the exemplary embodiment of the present invention will be explained.

The step portions 44 are formed at both sides of the developing region M at the developing sleeve 36 that constitutes the developing roll 32. The seal member 48 attached to the housing 28 is in contact with the region of this step portion 44 that faces the photoreceptor drum 12.

That is, the seal member 48 is fitted into the step portion 44. Accordingly, even if there is a tendency for developer to enter from the developing region M to the step portion 44, this is prevented by the seal member 48. As a result, a phenomenon where developer enters in between the step portion 44 and the seal member 48 and lifts the seal member 48 up so that the surface of the photoreceptor drum 12 is scratched can be prevented.

Further, in the above configuration, the distance between the seal member 48 and the photoreceptor drum 12 can be ensured (to be large) as compared with the seal members 48 being arranged without step portions at both sides of the developing roll 32 to regulate the width of the developing region M. Accordingly, contact between the seal member 48 and the photoreceptor drum 12 can be prevented. For this reason, the phenomenon where the seal member 48 contacts the surface of the photoreceptor drum 12 to wear the surface of the drum can be prevented.

Further, movement of the seal member 48 toward the developing region M side due to the step portion 44 is restricted. Therefore, the seal member 48 does not encroach on the developer layer P formed in the developing region M. Accordingly, the generation of stagnation such as where the density of the developer becomes denser locally can be prevented.

The edge portion of the seal member 48 is made to contact the wall surface 44A of the step portion 44, whereby it becomes more difficult for developer to enter in between the wall surface 44A of the step portion 44 and the seal member 48. Accordingly, the seal member 48 is not lifted up by the developer so that abrasion of the surface of the photoreceptor drum 12 due to the seal member 48 can be prevented.

Also, the seal member 48 is positioned in the vicinity of the end portions of the developing region M so that the phenomenon where the end portions of the developer layer P rise can be prevented.

Furthermore, the depth of the V grooves 46 of the developing region M of the developing sleeve 36 is made 0.09 mm, while the height of the wall surface 44A of the step portion 44 formed at both sides of the developing region M is made 0.1 mm. That is, the height of the wall surface 44A of the step portion 44 is made higher than the depth of the V grooves 46 formed in the developing region M. Therefore, a phenomenon that is likely to occur when the height of the wall surface 44A of the step portion 44 is made lower than the depth of the V groove 46 can be prevented, namely, developer entering between the step portion 44 and seal member 48 through the V grooves 46 can be prevented.

Also, the elastic seal member 48 is bridged over the opening 30 of the housing 28 in a state where tensile force is exerted. In this manner, the contact pressure of the seal member 48 with the step portion 44 increases so that it becomes harder for developer to enter in between the step portion 44 and seal member 48. Further, riding up of the seal member 48 to the developing region M side can be prevented.

Also, since the seal member 48 has elasticity, scratching of the developing sleeve 36 due to contact with the seal member 48 can be prevented.

Also, the contact pressure of the seal member 48 on the step portion 44 is set to be higher at the developing region M side than at the end portion sides of the developing roll 32 in the longitudinal direction thereof. For this reason, even if irregularities in contact pressure between the step portion 44 and seal member 48 occur, at least the contact pressure of the seal member 48 on the step portion 44 at the wall surface 44A side can be kept high. Accordingly, riding up of the seal member 48 onto the developing region M side can be prevented. Further, the developer in the developing region M can be prevented from entering in between the step portion 44 and seal member 48.

Note that with the present exemplary embodiment, the height of the wall surface 44A of the step portion 44 is made higher than the depth of the V groove 46, whereby the bottom surface 44B of the step portion 44 is made lower than the bottom portion of the V groove 46. Nevertheless, it is not absolutely necessary to configure the invention as described above. For example, even if the height of the wall surface 44A of the step portion 44 is lower than the depth of the V groove 46, the end portion of the seal member 48 can be made to contact the wall surface 44A of the step portion 44, whereby the developer of the developing region M can be prevented from entering into the step portion 44.

Also, with the present exemplary embodiment, the edge portion of the seal member 48 in the widthwise direction is configured to come into contact with the wall surface 44A of the step portion 44. However, just placing the edge portion of the seal member 48 in the vicinity of the wall surface 44A of the step portion 44 makes it difficult for the developer to enter in between the seal member 48 and the step portion 44. For this reason, it does not matter if there is some gap between the seal member 48 and the wall surface 44A of the step portion 44.

Further, the V grooves 46 are formed at the developing region M of the developing sleeve 36 such that the surface of the developing region M is subjected to surface roughening process, however, this surface roughening process is not limited to V-shaped grooves and can be indentations and protrusions.

Also, with the present exemplary embodiment, the thickness of the seal member 48 is made to be the same as the height of the wall surface 44A of the step portion 44, and the upper surface of the seal member 48 and the surface of the developing region M are made to be at the same height. Nonetheless, it is not imperative that the thickness of the seal member 48 be made the same as the height of the wall surface 44A of the step portion 44. The thickness of the seal member 48 can be made greater than the height of the wall surface 44A of the step portion 44, and the upper surface of the seal member 48 can also be in a state where it is protruding out further than the developing region M. In this case, the distance between the upper surface of the seal member 48 and the photoreceptor drum 12 is half or less the distance between the developing region M and the photoreceptor drum 12. Due to this, even if developer comes up against the edge portion of the seal member 48 jutting out from the developing region M, it is difficult for the developer to stagnate there.

The present invention may further include the following exemplary embodiments:

According to an aspect of the present invention is to provide a developing device having a seal material where the edge portion thereof is in contact with the wall surface of the step portion that is formed at both sides of the developing region of the developing roll and whose diameter is smaller than that of the developing region; and the seal material that contacts a region of the step portion that is opposite to the image carrier.

According to an aspect of the present invention is to provide a developing device including a developing roll having a plurality of grooves formed along the axial direction of the developing roll in which the grooves are formed by process for surface roughening process, and the height of the wall surface is higher than the depths of the grooves.

According to an aspect of the present invention is to provide a developing device comprising: a housing that stores developer; a developing roll that is rotatably supported in the housing and which has a developing region with a roughened surface that supplies developer to an image region of an image carrier; a step portion that is formed at both sides of the developing region of the developing roll and whose diameter is smaller than that of the developing region; and an elastic seal material that contacts a region of the step portion that is opposite to the image carrier and which is bridged over the opening 30 of the housing in a state where tensile force is exerted.

According to an aspect of the present invention is to provide a developing device comprising: a housing that stores developer; a developing roll that is rotatably supported in the housing and which has a developing region with a roughened surface that supplies developer to an image region of an image carrier; a step portion that is formed at both sides of the developing region of the developing roll and whose diameter is smaller than that of the developing region; and a seal material that contacts a region of the step portion that is opposite to the image carrier and whose contact pressure with the step portion is higher than at the end portion sides in the longitudinal direction of the developing roll.

According to an aspect of the present invention is to provide a developing device having an edge portion of the seal material in contact with a wall surface of the step portion.

According to an aspect of the present invention is to provide a developing device including a developing roll having a plurality of grooves formed along the axial direction of the developing roll in which the grooves are formed by process for surface roughening process, and the height of the wall surface is higher than the depths of the grooves.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device, comprising:

a housing that stores developer;

a developing roll that is rotatably supported in the housing and has a developing region with a roughened surface that supplies developer to an image region of an image holding member;

a step portion that is formed at both sides of the developing region of the developing roll and whose diameter is smaller than that of the developing region; and a seal member that contacts a region of the step portion that is opposite to the image holding member, wherein an edge portion of the seal member is in contact with a wall surface of the step portion, and wherein the roughened surface includes a plurality of grooves formed along the axial direction of the developing roll, and the height of the wall surface is higher than the depths of the grooves.

2. A developing device comprising:

a housing that stores developer;

a developing roll that is rotatably supported in the housing and has a developing region with a roughened surface that supplies developer to an image region of an image holding member;

a step portion that is formed at both sides of the developing region of the developing roll and whose diameter is smaller than that of the developing region; and an elastic seal member that contacts a region of the step portion that is opposite to the image holding member and which is bridged over an opening of the housing in a state where tensile force is exerted.

3. The developing device of claim 2, wherein an edge portion of the seal member is in contact with a wall surface of the step portion.

4. The developing device of claim 3, wherein the roughened surface includes a plurality of grooves formed along the axial direction of the developing roll, and the height of the wall surface is higher than the depths of the grooves.

5. A developing device comprising:

a housing that stores developer;

a developing roll that is rotatably supported in the housing and has a developing region with a roughened surface that supplies developer to an image region of an image holding member;

a step portion that is formed at both sides of the developing region of the developing roll and whose diameter is smaller than that of the developing region; and a seal member that contacts a region of the step portion that is opposite to the image holding member and whose contact pressure towards the step portion at the wall surface side is higher than at the end portion sides in the longitudinal direction of the developing roll.

6. The developing device of claim 5, wherein an edge portion of the seal member is in contact with a wall surface of the step portion.

7. The developing device of claim 6, wherein the roughened surface includes a plurality of grooves formed along the axial direction of the developing roll, and the height of the wall surface is higher than the depths of the grooves.

* * * * *